US009593567B2

(12) United States Patent
Pink et al.

(10) Patent No.: US 9,593,567 B2
(45) Date of Patent: Mar. 14, 2017

(54) AUTOMATED DRILLING SYSTEM

(71) Applicant: National Oilwell Varco, L.P., Houston, TX (US)

(72) Inventors: Tony Pink, Houston, TX (US); David Reid, Spring, TX (US); Andrew Bruce, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 369 days.

(21) Appl. No.: 14/361,198

(22) PCT Filed: Nov. 30, 2012

(86) PCT No.: PCT/US2012/067402

§ 371 (c)(1),
(2) Date: May 28, 2014

(87) PCT Pub. No.: WO2013/082498

PCT Pub. Date: Jun. 6, 2013

(65) Prior Publication Data

US 2014/0353033 A1 Dec. 4, 2014

Related U.S. Application Data

(60) Provisional application No. 61/565,736, filed on Dec. 1, 2011, provisional application No. 61/619,500, filed on Apr. 3, 2012.

(51) Int. Cl.
*E21B 44/00* (2006.01)
*E21B 44/02* (2006.01)

(52) U.S. Cl.
CPC ..... *E21B 44/02* (2013.01); *E21B 44/00* (2013.01)

(58) Field of Classification Search
CPC ..... E21B 44/00; E21B 44/02
See application file for complete search history.

(56) References Cited

U.S. PATENT DOCUMENTS 4,165,789 A 8/1979 Rogers
4,407,017 A 9/1983 Zhilikov et al.
(Continued)

FOREIGN PATENT DOCUMENTS

WO 02092966 11/2002
WO 2010101473 9/2010

OTHER PUBLICATIONS

Maidla et al., "Understanding Torque: The Key to Slide-Drilling Directional Wells," Society of Petroleum Engineers, IADC/SPE Drilling Conference 87162, dated Mar. 2-4, 2004 (7 pgs.).
(Continued)

*Primary Examiner* — Jennifer H Gay
(74) *Attorney, Agent, or Firm* — Derek V. Forinash; Porter Hedges LLP

(57) ABSTRACT

A drilling system comprises a drilling parameter sensor in communication with a sensor application 22 that generates processed data from raw data that is received from the drilling parameter sensor. A process application 24 is in communication with the sensor application 22 and generates an instruction based on the processed data. A priority controller is in communication with the process application 24 and evaluates the instruction for release to an equipment controller 14 that then issues the instruction to one or more drilling components.

20 Claims, 3 Drawing Sheets

(56) References Cited

U.S. PATENT DOCUMENTS 4,491,186 A 1/1985 Alder
4,662,608 A 5/1987 Ball
4,794,534 A 12/1988 Millheim
4,794,535 A 12/1988 Gray et al.
4,845,628 A 7/1989 Gray et al.
4,875,530 A 10/1989 Frink et al.
4,903,245 A 2/1990 Close et al.
5,318,136 A 6/1994 Rowsell et al.
5,331,318 A * 7/1994 Montgomery ..... E21B 47/12 340/855.4
5,358,059 A 10/1994 Ho
5,390,748 A 2/1995 Goldman
5,448,911 A 9/1995 Mason
5,474,142 A 12/1995 Bowden
5,654,503 A 8/1997 Rasmus
5,713,422 A 2/1998 Dhindsa
5,794,720 A 8/1998 Smith et al.
5,842,149 A 11/1998 Harrell et al.
5,864,058 A 1/1999 Chen
6,021,377 A 2/2000 Dubinsky et al.
6,026,912 A 2/2000 King et al.
6,029,951 A 2/2000 Guggari
6,065,332 A 5/2000 Dominick
6,084,826 A 7/2000 Leggett, III
6,109,368 A 8/2000 Goldman et al.
6,109,372 A 8/2000 Dorel et al.
6,131,673 A 10/2000 Goldman et al.
6,155,357 A 12/2000 King et al.
6,169,967 B1 1/2001 Dahlem et al.
6,192,998 B1 2/2001 Pinckard
6,233,524 B1 5/2001 Harrell et al.
6,272,434 B1 8/2001 Wisler et al.
6,293,356 B1 9/2001 King et al.
6,363,780 B1 4/2002 Rey-Fabret et al.
6,374,926 B1 4/2002 Goldman et al.
6,382,331 B1 5/2002 Pinckard
6,408,953 B1 6/2002 Goldman et al.
6,484,816 B1 11/2002 Koederitz
6,612,382 B2 9/2003 King
6,629,572 B2 10/2003 Womer et al.
6,662,110 B1 12/2003 Bargach et al.
6,691,779 B1 2/2004 Sezginer et al.
6,732,052 B2 5/2004 Macdonald et al.
6,766,854 B2 7/2004 Ciglenec et al.
6,782,322 B2 8/2004 Ireland
6,785,641 B1 8/2004 Huang
6,802,378 B2 10/2004 Haci et al.
6,820,702 B2 11/2004 Niedermayr et al.
6,868,920 B2 3/2005 Hoteit et al.
6,892,812 B2 5/2005 Niedermayr et al.
6,918,453 B2 7/2005 Haci et al.
6,944,547 B2 9/2005 Womer et al.
6,968,909 B2 11/2005 Aldred et al.
7,026,950 B2 4/2006 Guggari et al.
7,032,689 B2 4/2006 Goldman et al.
7,044,237 B2 5/2006 Leuchtenberg
7,054,750 B2 5/2006 Rodney et al.
7,059,427 B2 6/2006 Power et al.
7,082,821 B2 8/2006 Chen et al.
7,085,696 B2 8/2006 King
7,096,961 B2 8/2006 Clark et al.
7,096,979 B2 8/2006 Haci et al.
7,100,708 B2 9/2006 Koederitz
7,114,578 B2 10/2006 Hutchinson
7,128,167 B2 10/2006 Dunlop et al.
7,140,452 B2 11/2006 Hutchinson
7,142,986 B2 11/2006 Moran
7,168,506 B2 1/2007 Boucher et al.
7,172,037 B2 2/2007 Dashevskiy et al.
7,207,396 B2 4/2007 Hall et al.
7,243,735 B2 7/2007 Koederitz et al.
7,261,167 B2 8/2007 Goldman et al.
7,264,050 B2 9/2007 Koithan et al.
7,278,496 B2 10/2007 Leuchtenberg
7,283,060 B2 10/2007 Robison et al.
7,284,623 B2 10/2007 Rock
7,286,959 B2 10/2007 Steinke
7,299,132 B2 11/2007 Sayers et al.
7,305,303 B2 12/2007 Soehren et al.
7,313,480 B2 12/2007 Chen et al.
7,357,196 B2 4/2008 Goldman et al.
7,367,411 B2 5/2008 Leuchtenberg
7,373,993 B2 5/2008 Self et al.
7,394,064 B2 7/2008 Marsh
7,404,454 B2 7/2008 Hulick
7,422,076 B2 9/2008 Koederitz et al.
7,426,967 B2 9/2008 Sugiura
7,461,705 B2 12/2008 Hulick et al.
7,570,175 B2 8/2009 Johnson et al.
7,588,099 B2 9/2009 Kracik
7,604,072 B2 10/2009 Pastusek et al.
7,617,051 B2 11/2009 Sayers et al.
7,628,227 B2 12/2009 Marsh
7,649,473 B2 1/2010 Johnson et al.
7,650,950 B2 1/2010 Leuchtenberg
7,668,118 B2 2/2010 Johnson et al.
7,677,331 B2 3/2010 Lowe et al.
7,707,009 B2 4/2010 Steinke
7,730,967 B2 6/2010 Ballantyne et al.
7,733,240 B2 6/2010 Hall et al.
7,908,034 B2 3/2011 Gray
8,145,462 B2 * 3/2012 Foucault ..... E21B 44/00 702/6
8,406,927 B2 * 3/2013 Fontana ..... E21B 44/00 340/539.22
8,645,571 B2 2/2014 Downton et al.
8,672,055 B2 * 3/2014 Boone ..... E21B 7/04 175/26
9,175,557 B2 * 11/2015 Iversen ..... E21B 44/00
2004/0211595 A1 10/2004 Pinckard et al.
2004/0256152 A1 * 12/2004 Dashevskiy ..... E21B 44/00 175/25
2005/0189142 A1 9/2005 Garcia et al.
2005/0267719 A1 12/2005 Foucault
2006/0033637 A1 * 2/2006 Hall ..... E21B 47/12 340/853.1
2007/0057811 A1 3/2007 Mehta
2007/0185696 A1 8/2007 Moran et al.
2008/0156531 A1 7/2008 Boone et al.
2009/0078462 A1 * 3/2009 Boone ..... E21B 7/04 175/26
2009/0090555 A1 * 4/2009 Boone ..... E21B 44/02 175/45
2009/0132458 A1 * 5/2009 Edwards ..... G06N 5/025 706/50
2009/0225630 A1 9/2009 Zheng et al.
2010/0108384 A1 5/2010 Byreddy et al.
2010/0133008 A1 * 6/2010 Gawski ..... E21B 7/04 175/45
2010/0147510 A1 6/2010 Kwok et al.
2011/0031015 A1 * 2/2011 Downton ..... E21B 47/12 175/27
2011/0050453 A1 * 3/2011 Fontana ..... E21B 44/00 340/856.3
2011/0071963 A1 * 3/2011 Piovesan ..... G06Q 10/00 706/11
2011/0155461 A1 6/2011 Hutniak et al.
2012/0059521 A1 * 3/2012 Iversen ..... E21B 44/00 700/275
2014/0353033 A1 * 12/2014 Pink ..... E21B 44/02 175/27
2016/0097270 A1 * 4/2016 Pobedinski ..... E21B 44/00 700/275
2016/0208595 A1 * 7/2016 Tang ..... E21B 44/00

OTHER PUBLICATIONS

Search Report and Written Opinion dated Feb. 4, 2014 for corresponding International Application No. PCT/US2012067402 (13 pgs.).

(56) References Cited

OTHER PUBLICATIONS

Dashevskiy et al., "Application of Neural Networks for Predictive Control in Drilling Dynamics," SPE Annual Technical Conference and Exhibition, dated Oct. 3-6, 1999, Houston, Texas (9 pgs.).
Saasen et al., "Automatic Measurement of Drilling Fluid and Drill Cuttings Properties," IADC/SPE Drilling Conference, dated Mar. 4-6, 2008, Orlando, Florida, USA (17 pgs.).
Thorogood et al., "Drilling Automation: Technologies, Terminology and Parallels with other Industries," SPE/IADC Drilling Conference and Exhibition, dated Mar. 17-19, 2009, Amsterdam, The Netherlands (9 pgs.).
Rowsell et al., "Intelligent Control of Drilling Systems," SPE/IADC Drilling Conference, dated Mar. 11-14, 1991, Amsterdam, Netherlands (12 pgs.).
Hu et al., "Intelligent Drilling: A Prospective Technology of Tomorrow," International Oil & Gas Conference and Exhibition in China, dated Dec. 5-7, 2006, Beijing, China (5 pgs.).
Florence et al., "Multiparameter Autodrilling Capabilities Provide Drilling/Economic Benefits," SPE/IADC Drilling Conference and Exhibition, dated Mar. 17-19, 2009, Amsterdam, The Netherlands (10 pgs.).
Eustes III., "The Evolution of Automation in Drilling," SPE Annual Technical Conference and Exhibition, dated Nov. 11-14, 2007, Anaheim, California, U.S.A. (5 pgs.).
Sadlier et al., "Interoperability: An Enabler for Drilling Automation and a Driver for Innovation" SPE/IADC Drilling Conference and Exhibition, dated Mar. 1-3, 20011, Amsterdam, The Netherlands (12 pgs.).
Dupriest, Fred, "Borehole-Quality Design and Practices to Maximize Drill-Rate Performance," SPE Annual Technical Conference and Exhibition, dated Sep. 19-22, 2010, Florence, Italy (19 pgs.).
Pirovolou et al., "Drilling Automation: An Automatic Trajectory Control System," Society of Petroleum Engineers, SPE Digital Energy Conference and Exhibition, dated Apr. 19-21, 2011, The Woodlands, Texas (8 pgs.).
Dunlop et al., "Increased Rate of Penetration Through Automation," SPE/IADC Drilling Conference and Exhibition, dated Mar. 1-3, 20011, Amsterdam, The Netherlands (11 pgs.).
Gravdal et al., "Tuning of Computer Model Parameters in Managed-Pressure Drilling Applications Using an Unscented Kalman Filter Technique," SPE Annual Technical Conference and Exhibition, dated Oct. 9-12, 2005, Dallas, Texas (9 pgs.).
International Preliminary Report on Patentability dated Jun. 12, 2014 for corresponding International Application No. PCT/US2012067402 (9 pgs.).

* cited by examiner

AUTOMATED DRILLING SYSTEM

CROSS-REFERENCE TO RELATED APPLICATIONS

This application claims priority to U.S. Patent Application Ser. No. 61/565,736, titled Automatic Drilling System, which was filed Dec. 1, 2011 and to U.S. Patent Application Ser. No. 61/619,500, titled Drilling Control and Information System, which was filed Apr. 3, 2012. These priority applications are hereby incorporated by reference in their entirety into the present application, to the extent that it is not inconsistent with the present application.

BACKGROUND

This disclosure relates generally to methods and apparatus for automating drilling processes. More specifically, this disclosure relates to methods and apparatus for automating drilling processes utilizing input data from an external surface drilling rig interface with drilling machinery from a third party source as well as interacting with third party information downhole to facilitate a single closed loop control of a plurality of drilling parameters within the drilling system using a networked control system that can be customized based on the equipment being utilized and the processes being performed to have the user drive all the machinery drilling the well in an automated fashion with the users downhole sensing devices.

To recover hydrocarbons from subterranean formations, wells are generally constructed by drilling into the formation using a rotating drill bit attached to a drill string. A fluid, commonly known as drilling mud, is circulated down through the drill string to lubricate the drill bit and carry cuttings out of the well as the fluid returns to the surface. The particular methods and equipment used to construct a particular well can vary extensively based on the environment and formation in which the well is being drilled. Many different types of equipment and systems are used in the construction of wells including, but not limited to, rotating equipment for rotating the drill bit, hoisting equipment for lifting the drill string, pipe handling systems for handling tubulars used in construction of the well, including the pipe that makes up the drill string, pressure control equipment for controlling wellbore pressure, mud pumps and mud cleaning equipment for handling the drilling mud, directional drilling systems, and various downhole tools.

The overall efficiency of constructing a well generally depends on all of these systems operating together efficiently and in concert with the requirements in the well to effectively drill any given formation. One issue faced in the construction of wells is that maximizing the efficiency of one system can have undesirable effects on other systems. For example, increasing the weight acting on the drill bit, known as weight on bit (WOB), can often result in an increased rate of penetration (ROP) and faster drilling but can also decrease the life of the drill bit, which can increase drilling time due to having to more frequently replace the drill bit. Therefore, the performance of each system being used in constructing a well must be considered as part of the entire system in order to safely and efficiently construct the well.

Many conventional automated drilling systems are "closed loop" systems that attempt to improve the drilling process by sensing a limited number of conditions and adjusting system performance, manually or automatically, based upon the sensed conditions. Often these closed loop systems don't have the ability to monitor or consider the performance of all of the other systems being used or adjust the performance of multiple systems simultaneously. It is therefore left to human intervention to ensure that the entire system operates efficiently/satisfactorily.

Relying on human intervention can become complicated due to the fact that multiple parties are often involved in well construction. For example, constructing a single well will often involve the owner of the well, a drilling contractor tasked with drilling well, and a multitude of other companies that provide specialized tools and services for the construction of the well. Because of the significant coordination and cooperation that is required to integrate multiple systems from multiple companies, significant human intervention is required for efficient operation. Integrating multiple systems and companies becomes increasingly problematic as drilling processes advance in complexity.

Thus, there is a continuing need in the art for methods and apparatus for automating drilling processes that overcome these and other limitations of the prior art.

BRIEF SUMMARY OF THE DISCLOSURE

One embodiment of the disclosure provides a drilling system having a drilling parameter sensor in communication with a sensor application that generates processed data from raw data that is received from the drilling parameter sensor. A process application is in communication with the sensor application and generates an instruction based on the processed data. A priority controller is in communication with the process application and evaluates the instruction for release to an equipment controller that then issues the instruction to one or more drilling components.

BRIEF DESCRIPTION OF THE DRAWINGS

For a more detailed description of the embodiments of the present disclosure, reference will now be made to the accompanying drawings.

DETAILED DESCRIPTION

Figure 1:
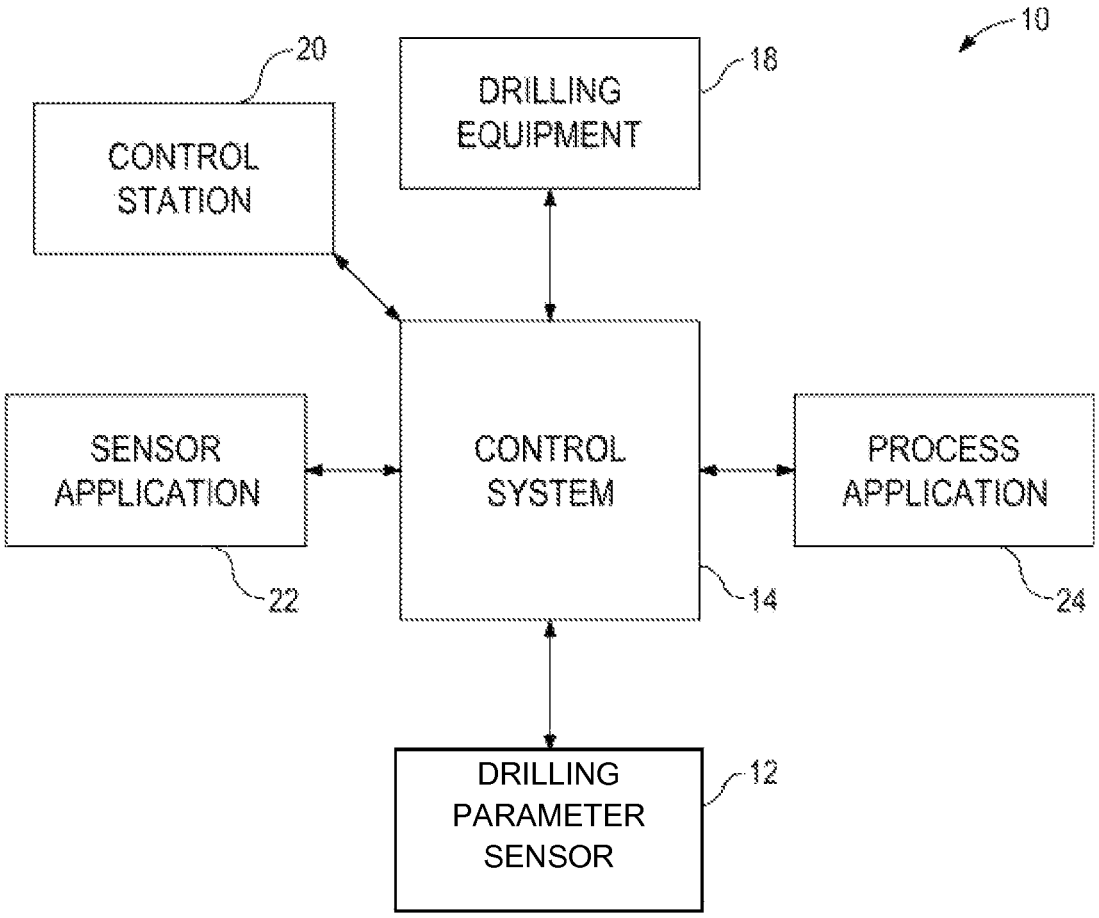
FIG. 1 is a simplified diagram of an automatic drilling system.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. For the purposes of this application, the term "real-time" means without significant delay.

Referring initially to FIG. 1, automated drilling system 10 can include a drilling parameter sensor 12 that is bidirectional communication with a control system 14 via a high-speed communication system 16 that can be capable of real-time, or near real-time communication. The drilling parameter sensor 12 can be any sensor operable to sense at least one drilling parameter and provide raw data regarding the drilling parameter to the control system 14. The drilling parameter sensor 12 may also be configured to receive operating instructions from the control system 14.

The drilling parameter sensor 12 can be mounted to any location necessary to sense the drilling parameter being monitored. For example, drilling parameter sensor 12 may be a downhole sensor or a rig-mounted sensor. A downhole drilling parameter sensor 12 may be disposed at the bottom hole assembly (BHA) or at any location along a drillstring and may include sensors for measuring downhole drilling parameters including, but not limited to, WOB, torque, revolutions per minute (RPM), temperature, vibration, acceleration, pressure, formation characterization, borehole condition, and drilling fluid condition. A rig-mounted drilling parameter sensor 12 may be configured to monitor a component of the drilling system, including, but not limited to, top drives, draw works, pipe handling equipment, pressure control equipment, mud cleaning equipment, pumps, blow out preventers, iron roughnecks, pipe rackers, centrifuges, shakers, heave compensators, dynamic positioning systems, accumulators, and valves, to measure one or more drilling parameters including, but not limited to, WOB, torque, revolutions per minute (RPM), temperature, vibration, acceleration, and pressure.

The control system 14 can also be in bidirectional communication with the drilling components 18 via a networked (wired or wireless is not specifically relevant) communication system. The control system 14 can provide operating instructions to the drilling components 18 in response to drilling parameters sensed by the drilling parameter sensors 12. The drilling components 18 can include, but are not limited to, top drives, draw works, pipe handling equipment, pressure control equipment, mud cleaning equipment, pumps, blow out preventers, iron roughnecks, pipe rackers, centrifuges, shakers, heave compensators, dynamic positioning systems, accumulators, and valves. The drilling components 18 can include one or more sensors that can monitor the performance of the equipment and provide feedback of the performance of the equipment to the control system 14.

The sensor application 22 and process application 24 can be in bidirectional communication with the control system 14. The sensor application 22 and the process application 24 are operable work with the control system 14 to process data received from the drilling parameter sensor 12, and other sensors, and provide operating instructions to one or more drilling component 18. In this manner, automated drilling system 10 allows the drilling process to be controlled and executed as well as adjusted and adapted using verification or command data collected by the drilling parameter sensor 12 or third party system.

In operation, the raw data collected by the drilling parameter sensor 12 is relayed by the communication system 16 to the control system 14. This data then enters the control system 14 where it is prioritized and distributed to one or more sensor applications 22. The data from a single drilling parameter sensor 12 may be provided to one or more sensor applications 22. Likewise, a single sensor application 22 may receive data from one or more drilling parameter sensors 12. The sensor application 22 can process the data received by the drilling parameter sensor 12, or by other sensors, and communicate the processed data back to the control system 14.

The control system 14 prioritizes and distributes the processed data to one or more process applications 24. The processed data can be received by one or more process applications 24 that can generate an instruction to modify an operating parameter of one or more drilling components 18. The process applications 24 receive data, including, but not limited to, data processed by the sensor applications 22, and analyze that data in order to evaluate the performance of the drilling components and issue instructions to modify the operating parameters of one or more drilling components 18 as needed. For example, a process application 24 can be configured to provide instructions to the drilling components 18 to manage surface WOB, torque, and RPM in response to downhole WOB, downhole torque and downhole vibration data collected by the drilling parameter sensor 12. Other process applications 24 can include, but are not limited to applications for managing control hole cleaning, equivalent circulating density (ECD) management, managed pressure drilling (MPD), kick detection, directional drilling, and drilling efficiency.

The control station 20 can be in bidirectional communication with the control system 14 and provide a user interface that can be accessed by an operator on the rig or in a remote location. The control station 20 provides a location for providing manual input to the control system 14 and for manual override of the control system 14 if needed. The control station 20 can provide visual representation of the operation of the system including the status of one or more drilling components 18 and a real-time representation of data received from the drilling parameter sensors 12.

Automated drilling system 10 provides a customizable, open concept control system where customized sensor applications 22 and/or process applications 24 allow the drilling process to be tailored to meet the specific needs of drilling contractors and rig operators. Automated drilling system 10 allows a plurality of sensor applications 22 and/or process applications 24 to be developed and selectively integrated into the control system 14 as needed. This enables the automated drilling system 10 to be easily adapted for a variety of implementations.

Figure 2:
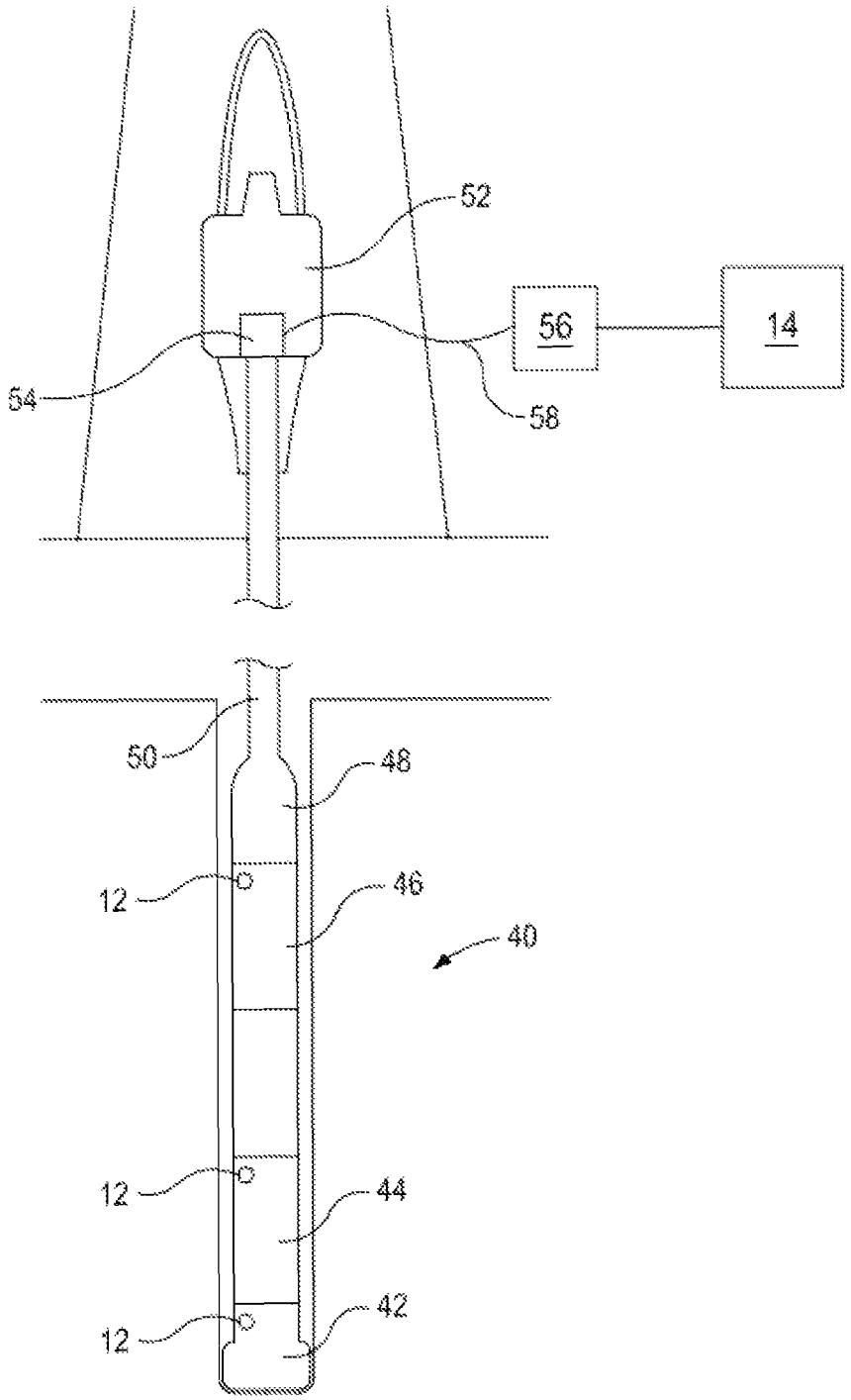
FIG. 2 is a simplified schematic diagram of a drill string used as part of an automatic drilling system.

Referring now to FIG. 2, an exemplary BHA 40 can include a bit 42, a drive system 44, a sensor module 46, and a communication sub 48. The BHA 40 can be coupled to the rotating system, 52, or other surface equipment, via drill pipe 50. The bit 42, the drive system 44, the sensor module 46, and the drill pipe 50 can each include one or more drilling parameter sensors 12 to measure a selected drilling parameter, including, but not limited to, WOB, torque, RPM, temperature, vibration, acceleration, and pressure.

The drilling parameter sensors 12 can be in bidirectional communication with the communication sub 48 via a wired or wireless connection. The communication sub 48 can be operable to receive data collected from each of the drilling parameter sensors 12 and transmit the data to the surface via communication system 16. The communications sub 48 can also be operable to receive control signals and other signals from the surface and relay those signals to one or more sensors 12 or other tools within the BHA 40.

The communication system 16 can be any system suitable for the transmission of data and other signals between the BHA 40 to the surface at relatively high rates of speed. In certain embodiments, the communication system 16 supports continuous, real-time communication between the BHA 40 and the surface. Suitable communication systems 16 can utilize communication methods that include, but are not limited to, electric signals along wired drill pipe, mud-pulse telemetry, fiber optics, wireless signals, acoustic signals, and electromagnetic signals.

The data transmitted from the BHA 40 can be received at the surface by surface communications link 54. The surface communications link 54 may be integrated into a component such as a swivel, internal blow out preventer (IBOP), or into an instrumented saver sub coupled to the drill string. The surface communications link 54 can be configured to transmit data to the communication controller 56 via a wired or wireless link 58. The communication controller 56 can be coupled to the control system 14 and operable to manage the flow of data between the control system 14 and the surface communications link 54. The communications controller 56 can also be in bidirectional communication with other sensors located at the surface, including sensors mounted on drilling components 18.

Figure 3:
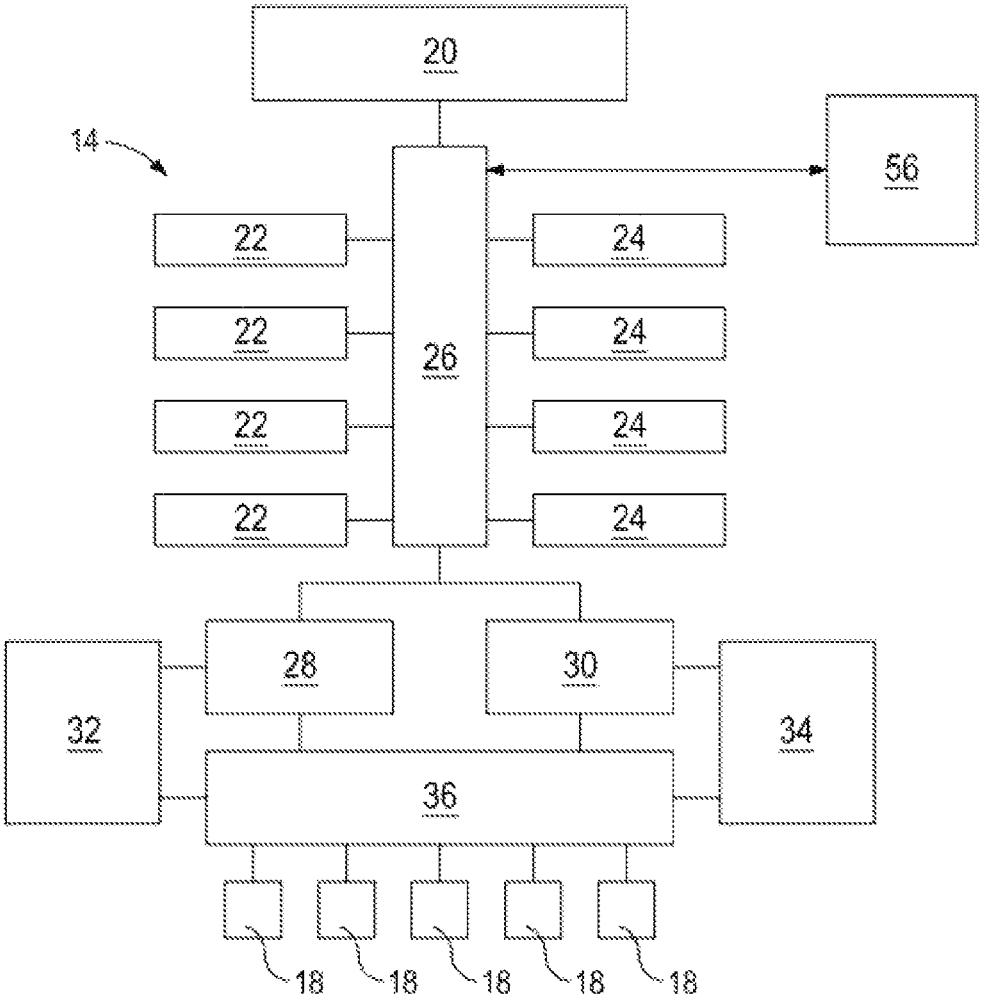
FIG. 3 is a simplified diagram of a control system for an automatic drilling system.

Referring now to FIG. 3, the control system 14 can include an internal communication bus 26, a network interface 28, a priority controller 30, data storage 32, a simulator interface 34, and a hardware controller 36. The internal communication bus 26 can also be in bidirectional communication with one or more sensor applications 22, one or more process applications 24, a control station 20, and communication controller 56. The network interface 28 can also be in bidirectional communication with external sources and users of information so that drilling operations and rig performance can be remotely monitored and controlled.

In operation, raw data from drilling parameter sensors 12, and other sources, is received by internal communication bus 26 via communication controller 56. The internal communication bus 26 sends the data to the network interface 28. The network interface 28 receives raw data from the plurality of drilling parameter sensors 12, other sensors, and from external sources, such as offsite engineering or technical experts. The network interface 28 categorizes and sorts this data and then distributes the data back through the internal communication bus 26 to the sensor applications 22 and/or process applications 24 that can process that data.

In order to provide flexibility and support the use of the control system 14 with a variety of drilling and completion operations, the control system 14 can be configured with customized sensor applications 22 and process applications 24 as needed for the particular operation. This allows control system 14 to be easily customized for use with specific drilling parameter sensors and the equipment available on a specific rig. If the rig equipment or drilling parameter sensors are changed, the corresponding applications on the control system 14 can also be changed without having to reprogram the entire control system.

The sensor application 22 can be operable to receive raw data from one or more drilling parameter sensors 12, or other sensors, and generate processed data. The sensor application 22 can be operable to generate processed data representing downhole conditions including, but not limited to, WOB, torque, RPM, temperature, vibration, acceleration, and pressure. The processed data is then transmitted by internal communication bus 26 to the process applications 24 that can utilize the processed data to generate an instruction.

The processed data can be received by one or more process applications 24 that can generate an instruction that may modify an operating parameter of one or more drilling components 18, display a status of the drilling operation, or cause another function to be performed. The process applications 24 receive data, including, but not limited to, data processed by the sensor applications 22, and analyze that data in order to evaluate the performance of the drilling components and issue instructions to modify the operating parameters of one or more drilling components 18 as needed. For example, a process application 24 can be configured to provide instructions to the drilling components 18 to manage surface WOB, torque, and RPM in response to downhole WOB, downhole torque and downhole vibration data collected by a drilling parameter sensor 12. Other process applications 24 can include, but are not limited to applications for managing control hole cleaning, equivalent circulating density (ECD) management, managed pressure drilling (MPD), kick detection, directional drilling, and drilling efficiency.

Multiple sensor applications 22 and process applications 24 can simultaneously be in bidirectional communication with the control system 14. As described above, the sensor applications 22 and/or the process applications 24 can analyze and/or process collected data to generate an answer, which can include an instruction, measurement, operating condition, data point, or other information. Instructions generated by the process applications are then transmitted to the priority controller 30.

The priority controller 30 monitors the performance of the entire drilling process and determines if the instructions generated by the process applications 24 can be implemented. For example, if a process application 24 generates an instruction for a drilling component to perform a certain function, the priority controller 30 determines if that function can be safely performed. Once an instruction has been cleared by the priority controller 30, that answer released by the priority controller 30 and can be sent to the hardware controller 36 or other component of the control system. The needs of the drilling operation will be given priority after the system has assessed priority, solely as an example a priority plan could be listed as follows: (1) safety considerations as defined by on site conditions; (2) machine limitations (could be assessed based on work yet to be done before maintenance is to be performed and available materials to maintain) as may be defined by equipment suppliers and supply chain; (3) well restrictions to avoid collapse or fracture as may be defined by the geologist and verified by defined on site personnel; (4) formation target accuracy as may be defined by the directional driller; (5) rate of penetration as may be defined by the company man; and (6) quality of well as may be defined by the petrophysicist.

Once the instruction has been released by the priority controller 30, it can be routed to one or more of the hardware controller 36, simulator interface 34, data storage 32, or other system components. The hardware controller 36, which can include one or more primary logic controllers and/or single board controllers, can provide operating instructions to one or more drilling components 18. Data storage 32 can store both raw and processed data as well as any instructions sent to the drilling components 18. The simulator interface 34 may receive all the instructions that hardware controller 36 sends to the drilling components 18 so that those instructions can be provided to a drilling simulator that can replicate the instructions and predict the outcome of the operation.

In one embodiment, a sensor application 22 can monitor one or more drilling parameter sensors 12 to compute a mechanical specific energy (MSE) and ROP. This data can be transmitted to a process application 24 that can vary one or more drilling parameters including, but not limited to, surface WOB, surface torque, and mud motor pressure. The process application 24 then can continue to receive information from the sensor application and adjust the drilling parameters in order to optimize the drilling process as desired by either minimizing MSE or maximizing ROP. Other sensor applications 22 can provide real time downhole measurements of downhole WOB, downhole torque, and downhole RPM that the process application 24 can use to optimize the drilling process.

In another embodiment, a sensor application 22 can receive data from one or more drilling parameter sensors 12 to determine downhole vibrations, oscillations, stick-slip movement, or other dynamic movement in the drill string that can reduce the efficiency of the drilling process. The processed data can be sent to a process application 24 that will vary drilling parameters including, but not limited to, surface RPM and surface WOB, in order to reduce any undesired movements.

In yet another embodiment, a process application 24 may be a pump pressure management application that utilizes processed data generated by one or more sensor applications 22 that acquire raw data from drilling parameter sensors monitoring downhole pressure, pump pressure, annulus pressure, and other wellbore pressures. The pump pressure management application can control the fluid pressure being pumped into the wellbore, by varying pump pressure, and then monitor the pressure returning to the surface to evaluate a variety of drilling conditions including, but not limited to, kick detection, hole cleaning, wellbore stability, and other flow issues.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A drilling system comprising:

a plurality of drilling parameter sensors;

a plurality of sensor applications, wherein each of the plurality of sensor applications is in communication with at least one of the plurality of drilling parameter sensors and is operable to generate processed data from raw data that is received from the at least one of the plurality of drilling parameter sensors, wherein a first one of the plurality of sensor applications computes a mechanical specific energy, and wherein a second one of the plurality of sensor applications computes a dynamic movement of the drill string;

a plurality of process applications, wherein each of the plurality of process applications are in communication with at least one of the plurality of sensor applications and is operable to generate an instruction based on the processed data generated by the at least one of the plurality of sensor applications, wherein each one of the process applications generates an instruction to change surface weight on bit and an instruction to change surface torque;

a priority controller in communication with the plurality of process applications and operable to evaluate the instructions for release, wherein the priority controller assesses priority of the instructions based on a priority plan that at least includes, in this order, avoiding collapse or fracture of the well, formation target accuracy, rate of penetration, and quality of well, and wherein the priority controller determines whether the instructions can be released based on the assessed priority; and an equipment controller in communication with the priority controller and operable to issue the instructions to one or more drilling components when the instructions are released by the priority controller.

2. The system of claim 1, further comprising a network interface operable to control data transmission between the plurality of drilling parameter sensors, the plurality of process applications, and the plurality of sensor applications.

3. The system of claim 2, further comprising data storage coupled to the network interface.

4. The system of claim 1, further comprising a simulator interface operable to receive instructions from the priority controller.

5. The system of claim 1, further comprising a control station coupled to the equipment controller and operable to display the status of one or more drilling components.

6. The system of claim 1, wherein at least one of the plurality of process applications is operable to generate an instruction based on processed data generated by more than one of the plurality of sensor applications.

7. The system of claim 1, wherein at least one of the plurality of drilling parameter sensor is a downhole sensor.

8. The system of claim 1, wherein at least one of the plurality of drilling parameter sensors is a rig-mounted sensor.

9. A method of controlling a drilling process comprising:

collecting data using a plurality of drilling parameter sensors;

transmitting the data to a control system including a plurality of sensor applications and a plurality of process applications;

processing the data using at least one of the plurality of sensor applications to provide a representation of a drilling parameter;

generating an instruction by analyzing the representation of a drilling parameter using at least one of the plurality of process applications;

evaluating the instruction with a priority controller to determine if the instruction can be released based on a priority plan that includes, in this order, avoiding collapse or fracture of the well, formation target accuracy, rate of penetration, and quality of well; and transmitting the instruction to one or more drilling components when the instruction is released by the priority controller.

10. The method of claim 9, further comprising transmitting additional data to the control system from a network interface.

11. The method of claim 10, further comprising coupling data storage to the network interface.

12. The method of claim 9, further comprising transmitting the instruction to a simulator interface.

13. The method of claim 9, further comprising displaying a status of one or more drilling components on a control station.

14. The method of claim 9, whereby the priority controller is operable to evaluate a plurality of instructions issued by the plurality of process applications.

15. The method of claim 9, wherein at least one of the plurality of drilling parameter sensors is a downhole sensor.

16. The method of claim 9, wherein at least one of the plurality of drilling parameter sensor is a rig-mounted sensor.

17. A drilling control system comprising:

a plurality of sensor applications operable to generate processed drilling data from raw drilling data that is received from one or more sensors, wherein a first one of the plurality of sensor applications computes a mechanical specific energy, and wherein a second one of the plurality of sensor applications computes a downhole pressure;

a plurality of process applications operable to generate operating instructions based on the processed drilling data that is generated by the plurality of sensor applications, wherein a first one of the process applications generates an instruction to change a mud motor pressure, and wherein a second one of the process applications generates an instruction to change a pump pressure;

a priority controller operable to evaluate and selectively release the operating instructions, wherein the priority controller assesses a priority of the instructions based on a priority plan that at least includes, in this order, avoiding collapse or fracture of the well, formation target accuracy, rate of penetration, and quality of well, and wherein the priority controller determines whether the instructions can be released based on the assessed priority; and a plurality of equipment controllers operable to receive operating instructions that have been released by the priority controller and issue released operating instructions to one or more drilling components.

18. The system of claim 17, further comprising a control station operable to display the status of one or more drilling components.

19. The system of claim 17, wherein the one or more sensors comprises a downhole sensor.

20. The system of claim 17, wherein the one or more sensors comprises a rig-mounted sensor.

* * * * *